US005902012A

United States Patent [19]

Han

[11] Patent Number: 5,902,012

[45] Date of Patent: May 11, 1999

[54] CHAIR WITH MOVABLE BACK

[76] Inventor: Moogil Han, 57-113, Noyu 2 ga 4 dong, Kwangjin-gu, Seoul, Rep. of Korea

[21] Appl. No.: 09/054,531

[22] Filed: Apr. 3, 1998

[30] Foreign Application Priority Data

Apr. 3, 1997 [KR] Rep. of Korea ..... 97-6801

[51] Int. Cl.[6] ..... A47C 3/023; A47C 3/025

[52] U.S. Cl. ..... 297/285; 297/296; 297/297

[58] Field of Search ..... 297/285, 284.1, 297/296, 297, 298

[56] References Cited

U.S. PATENT DOCUMENTS

| | | | |
|---|---|---|---|
| 4,451,085 | 5/1984 | Franck et al. | 297/285 X |
| 4,549,764 | 10/1985 | Haedo | 297/296 |
| 4,557,521 | 12/1985 | Lange | 297/285 |
| 4,580,836 | 4/1986 | Verney | 297/296 |
| 4,585,272 | 4/1986 | Ballarini | 297/285 X |
| 4,603,904 | 8/1986 | Tolleson et al. | 297/285 X |
| 4,756,575 | 7/1988 | Dicks | 297/285 X |
| 4,790,595 | 12/1988 | Kensel | 297/285 |
| 4,869,552 | 9/1989 | Tolleson et al. | 297/296 |
| 4,913,493 | 4/1990 | Heidmann | 297/285 |
| 5,039,163 | 8/1991 | Tolleson | 297/297 |
| 5,108,149 | 4/1992 | Ambasz | 297/297 X |

*Primary Examiner*—Peter M. Cuomo
*Assistant Examiner*—Rodney B. White
*Attorney, Agent, or Firm*—Armstrong, Westerman, Hattori, McLeland & Naughton

[57] ABSTRACT

A chair, with an elastic movable means capable of allowing the back of the chair to be leaned back at an angle of inclination, is disclosed. The chair has one or more leg frames. A seat frame is mounted to the top portion of the leg frames and holds a seat. A back frame is connected to the seat frame and holds a back. The elastic movable means is provided at the junction between the seat and back frames and allows the back frame to be elastically leaned back relative to the seat frame. The elastic movable means has two leaning angle limit units at both ends and one torsion bar extending between the two limit units. Each of the two limit units is fitted into the seat and back frames at opposite ends and limits the leaning angle of the back frame. The torsion bar elastically returns the back frame from a leaned position to the original position.

7 Claims, 5 Drawing Sheets

CHAIR WITH MOVABLE BACK

BACKGROUND OF THE INVENTION

1. Field of the Invention

The present invention relates, in general, to a chair with a plurality of hollow steel pipes being bent into seat and back frames and, more particularly, to a chair provided with an elastic movable means capable of allowing the back of the chair to be elastically leaned back and returned to its original position.

2. Description of the Prior Art

As well known to those skilled in the art, chairs, with a plurality of hollow steel pipes being bent into seat and back frames, have a simple construction and are produced at low cost, thus being widely used as seats in a banquet hall, etc. In order to produce such a chair, a plurality of steel pipes, having a rectangular or circular cross-section, are bent into a seat frame and a back frame. Thereafter, a seat is mounted to the seat frame, while a back is mounted to the back frame, thereby easily forming such a chair and reducing production cost.

However, such a chair is problematic in that the back frame is fixed to the seat frame, so the back can not be movable relative to the seat. Therefore, the above chair, with the fixed back only supporting the back of a user, does not allow the user, who wants to take a rest, to lean back in the chair. That is, such chairs are not comfortable to users.

In an effort to solve the above problem, a chair, with a movable means installed in the steel pipe frames for allowing the back to be selectively leaned back, is proposed. However, such a movable means has a complex construction, so it is very difficult to practically install the movable means in the steel pipe frames since the construction of such a chair is too simple to be modified in order to carry such a movable means. In addition, the hollow structure of the steel pipe frames is not strong, so the frames can not effectively hold such a movable means and causes the movable means to be easily broken down.

SUMMARY OF THE INVENTION

Accordingly, the present invention has been made in view of the above problems occurring in the prior art, and an object of the present invention is to provide a chair, which is provided with an elastic movable means capable of allowing the back of the chair to be leaned back at an angle of inclination, thereby allowing a user to easily take a comfortable rest in a leaning back position when necessary.

In order to accomplish the above object, the present invention provides a chair, comprising: one or more leg frames; a seat frame mounted to a top portion of the leg frames and holding a seat; a back frame connected to the seat frame and holding a back of the chair; and elastic movable means provided at a junction between the seat and back frames and adapted for allowing the back frame to be elastically leaned back relative to the seat frame, the elastic movable means having two leaning angle limit units at both ends and a torsion bar extending between the two leaning angle limit units, each of the leaning angle limit units being fitted into the seat and back frames at opposite ends and being adapted for limiting a leaning angle of the back frame, and the torsion bar elastically returning the back frame from a leaned position to its original position.

BRIEF DESCRIPTION OF THE DRAWINGS

The above object, and other features and advantages of the present invention will be more clearly understood from the following detailed description taken in conjunction with the accompanying drawings, in which.

DESCRIPTION OF THE PREFERRED EMBODIMENT

Figure 1:
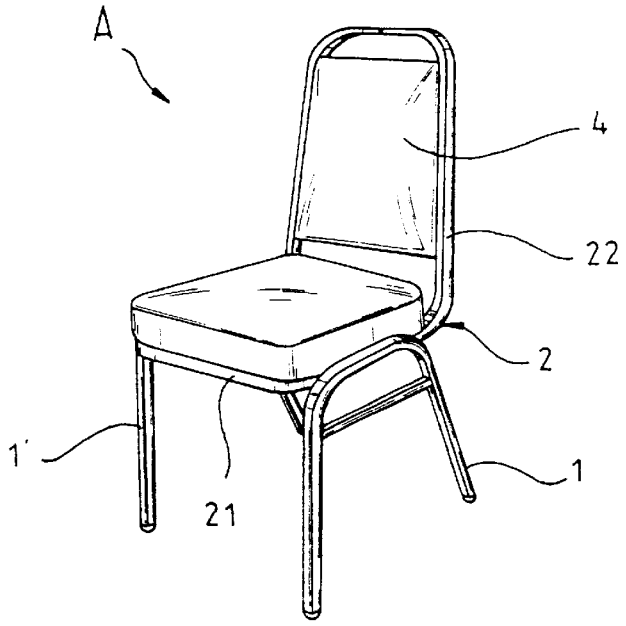
FIG. 1 is a schematically perspective view of a chair in accordance with the preferred embodiment of the present invention.
Figure 2:
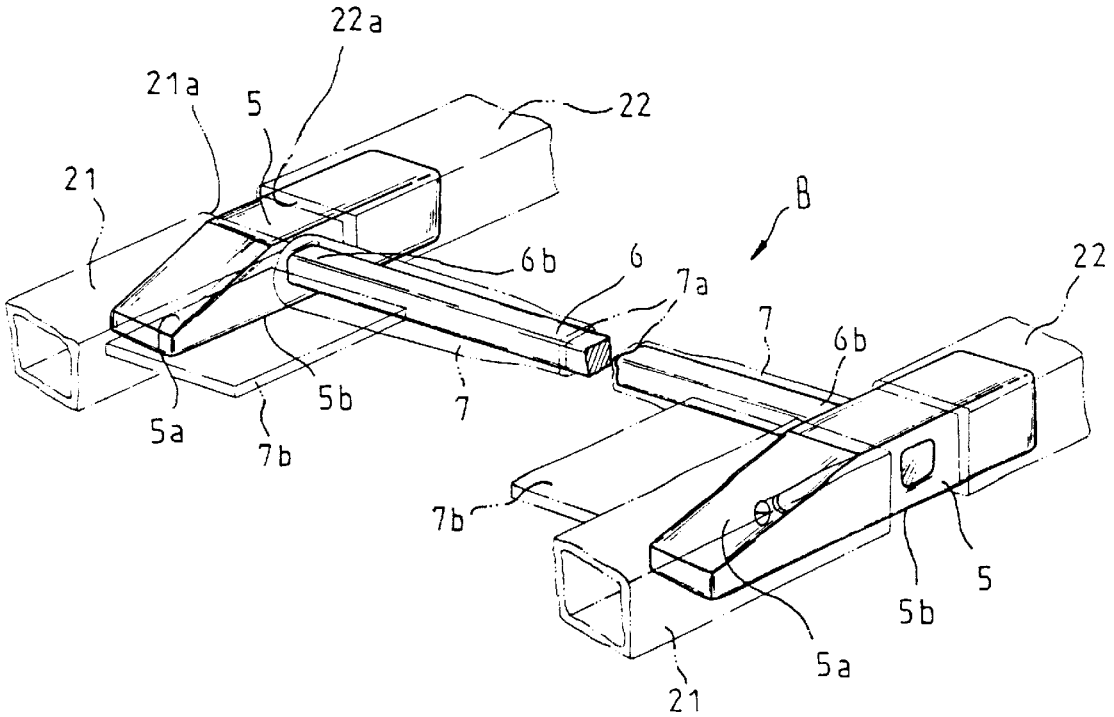
FIG. 2 is a perspective view showing the construction of an elastic movable means installed in the chair in accordance with the primary embodiment of this invention.
Figure 3:
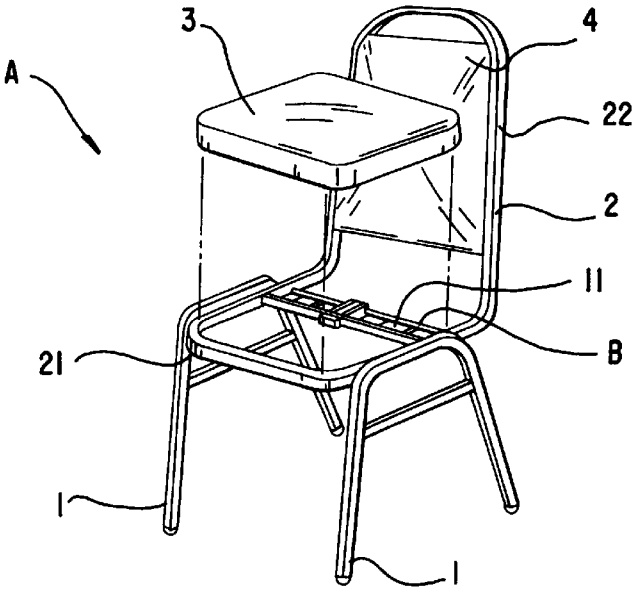
FIG. 3 is an exploded perspective view of a chair with an elastic movable means in accordance with the second embodiment of this invention.

FIG. 1 is a schematically perspective view of a chair in accordance with the preferred embodiment of the present invention. FIG. 2 is a perspective view showing the construction of an elastic movable means installed in the above chair.

As shown in FIG. 1, the chair "A" comprises two or more leg frames 1 forming four legs. Mounted to the top portion of the leg frames 1 is a body frame 2 which holds a seat 3 and a back 4.

That is, the leg frames 1, formed of hollow steel pipes individually having a rectangular or circular cross-section, are individually bent at two points, thereby forming the four legs of the chair "A". The body frame 2 are formed of a hollow steel pipe similar to the pipes of the above leg frames 1. The body frame 2 comprises two frames: a seat frame 21 mounted to the top portion of the leg frames 1 and a back frame 22 connected to the seat frame 21. In the body frame 2, the seat 3 is mounted to the seat frame 21, while the back 4 is mounted to the back frame 22. In order to accomplish the object of this invention, an elastic movable means "B" is provided at the junction between the seat frame 21 and the back frame 22. The above means "B" allows the back frame 22 to be elastically leaned back relative to the seat frame 21 when necessary.

In a detailed description, the elastic movable means "B" is set between the cutting ends 21*a* of the seat frame 21 and the cutting ends 22*a* of the back frame 22 as shown in FIG. 2. In the elastic movable means "B", two leaning angle limit units 5 are provided at both ends, while a longitudinal torsion bar 6 extends between the two limit units 5. Each of the two limit units 5 is fitted into the seat and back frames 21 and 22 at both ends, thereby limiting the leaning angle of the back frame 22 relative to the seat frame 21.

Each of the two limit units 5 is tapered on its top surface at a portion fitted into the seat frame 21, thus forming a tapered top surface 5*a* having an angle θ of inclination. As a result, the leaning angle of the back frame 22 relative to the seat frame 21 is limited within the tapering angle of the above top surfaces 5*a*.

When the back frame 22 is positioned at its original position, the bottom portion 5*b* of each of the two limit units 5 comes into contact with the lower surfaces 21*b* and 22*b* of the two frames 21 and 22. In addition, an inserting hole 5*b* is formed on the central portion of the side wall of each of the two limit units 5, thus allowing the torsion bar 6 to be easily inserted into the hole 5*b* at each end.

In the present invention, the tapering angle θ of the limit unit's top surfaces 5*a* may be freely changed in accordance with a desired leaning angle of the back frame 22 relative to the seat frame 21. In such a case, it should be understood that the leaning angle of the back frame 22 is in proportion to the tapering angle θ of the top surfaces 5*a*.

In the preferred embodiment of this invention, each of the two limit units 5 is formed of a cast-iron product. However, each limit unit 5 may be formed of an aluminum or synthetic resin material through a molding process without affecting the functioning of this invention.

The two limit units 5, fixed to the body frame 2, are integrated with each other by the torsion bar 6. Such a torsion bar 6 is designed to be twisted when a torque is applied to the torsion bar 6. However, when the torque is removed from the torsion bar 6, the bar 6 is elastically returned to its original position due to its restoring force.

In the preferred embodiment of this invention, the torsion bar 6 has a rectangular cross-section. However, the cross-section of the torsion bar 6 is not limited to the rectangular cross-section of FIG. 2 but may be freely changed into various cross-sections without affecting the functioning of this invention.

Such a torsion bar 6 is inserted into a support pipe 7, thus being held by the pipe 7. Both ends of the above pipe 7 are mounted to the seat frame 21. Therefore, the pipe 7 allows the torsion bar 6 to be elastically returned to its original position without failure.

As best seen in FIG. 2, the central portion 7*a* of the support pipe 7 has a rectangular cross-section similar to that of the torsion bar 6, thus preventing the torsion bar 6 from being unexpectedly rotated relative to the pipe 7. Also, a reinforcing plate 7*b* is welded to both the side wall of the seat frame 21 and each end portion of the pipe 7, thus preventing the two limit units 5 from being unexpectedly separated from the seat frame 21.

FIGS. 3 to 6 are views illustrating an elastic movable means in accordance with the second embodiment of the present invention. In the second embodiment, the elastic movable means "B" comprises two leaning angle limit units 5 and one torsion bar 6 in the same manner as that described for the primary embodiment.

In the elastic movable means "B" according to the second embodiment, each of the two leaning angle limit units 5 is positioned at the junction between the cutting ends 21*a* and 22*a* of the seat and back frames 21 and 22. Also, the torsion bar 6 extends between the two limit units 5 with both ends of the bar 6 being inserted into the insert holes 5*c* of the units 5.

Different from the primary embodiment, the central portion of the torsion bar 6 is provided with a restoring force adjusting means "C" which is used for selectively adjusting the restoring force of the elastic movable means "B". The above adjusting means "C" comprises a movable member 7 and a fixed bar 9. The movable member 7 is mounted to the torsion bar 6 at one end, thus being rotatable along with the torsion bar 6. An adjustable screw 8 is vertically and upwardly threaded into the other end of the movable member 7. Meanwhile, the fixed bar 9 is fixed to the seat frame 21 at both ends and is seated on the adjustable screw 8 at the middle portion. Therefore, when the adjustable screw 8 is tightened or loosened, the movable member 7 is rotated in either direction in accordance with a moving direction of the screw 8, thus adjusting the initially twisted position of the torsion bar 6 and controlling the restoring force of the elastic movable means "B". In order to stably seat the fixed bar 9 on the adjustable screw 8 without allowing the bar 9 to be unexpectedly removed from the screw 8, a groove 71 is formed on the upper portion of the movable member 7 at a position around the screw 8.

Figure 4:
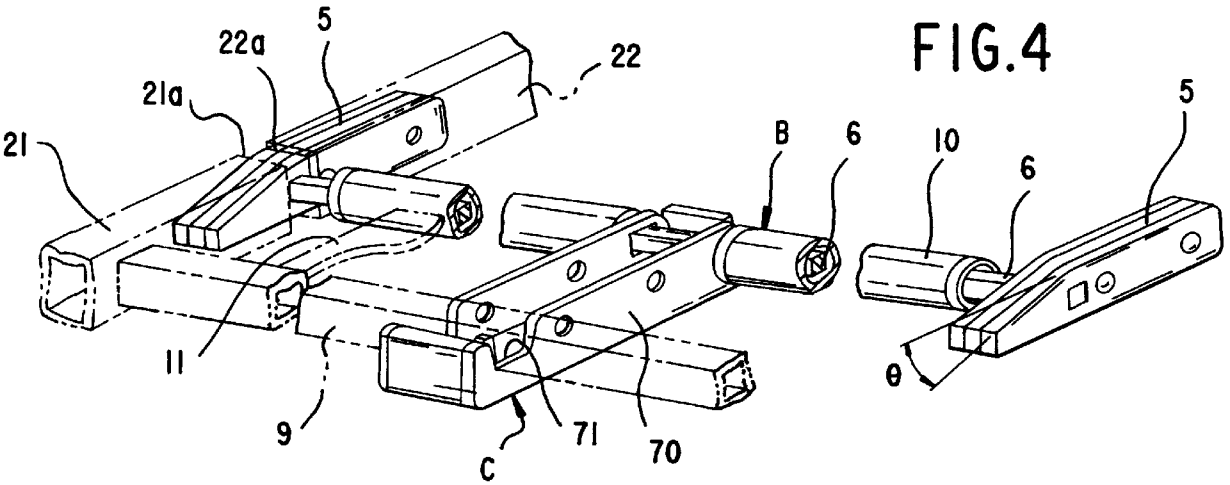
FIG. 4 is a perspective view showing the construction of the elastic movable means of FIG. 3.
Figure 5:
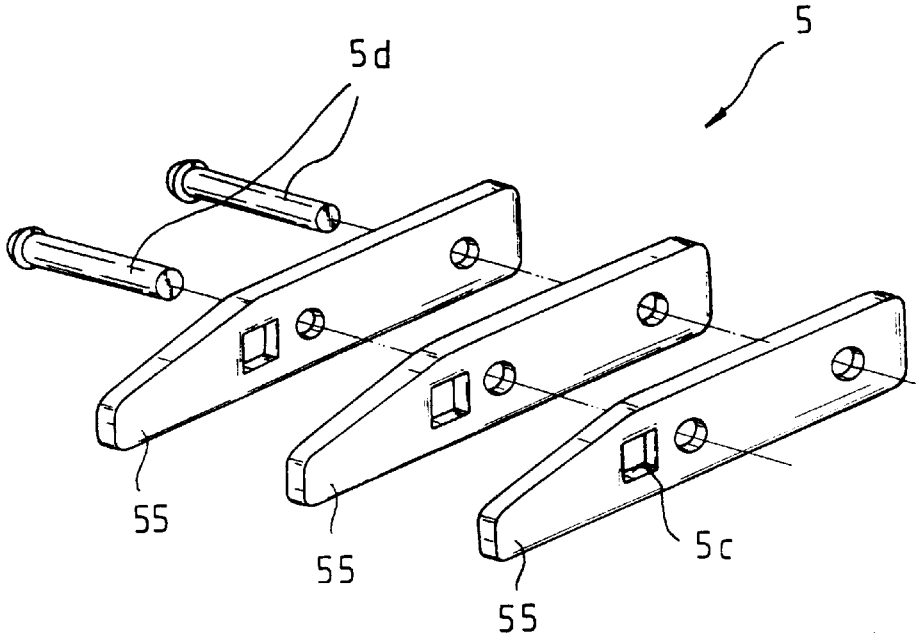
FIG. 5 is an exploded perspective view of a leaning angle limit unit included in the elastic movable means of FIG. 4.

FIG. 5 is an exploded perspective view of a leaning angle limit unit included in the elastic movable means "B" of FIG. 4. As shown in FIG. 5, the two limit units 5 are individually formed of three metal members 55. That is, the three metal members 55, having the same profile, are coupled to each other into a single body by a coupling means such as a rivet 5*d*. The three members 55 also may be integrated into a single body through a welding process.

In the embodiment of FIG. 5, a plurality of insert holes 5*c* are formed on each of the three members 55 through a cutting process such as a punching process. Therefore, it is possible to easily assemble the units 5 with the torsion bar 6 through a fitting process without affecting the accuracy of the elastic movable means "B". The assembling process of integrating the units 5 with the torsion bar 6 is thus simplified, improving work efficiency and reducing the production cost while producing the chair. In addition, the three metal members 55 are treated through a heat treatment process so as to improve the strength of the resulting units 5.

Figure 6:
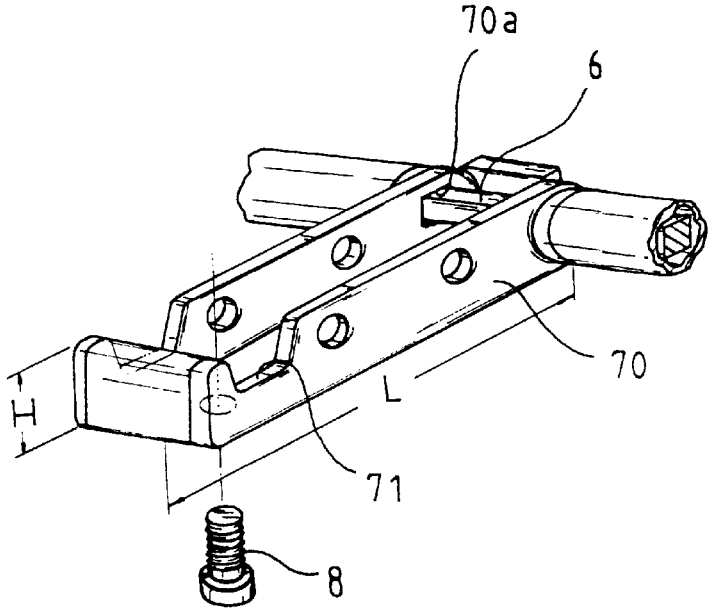
FIG. 6 is a schematically perspective view illustrating an adjusting means used for adjusting the restoring force of the elastic movable means of FIG. 4.

FIG. 6 is a schematically perspective view illustrating the restoring force adjusting means "C" used for adjusting the restoring force of the elastic movable means "B" of FIG. 4.

As shown in FIGS. 4 and 6, the adjusting means "C" is mounted to the central portion of the elastic movable means "B". That is, the torsion bar 6 is inserted into the fixing holes 70*a* formed on one end of a movable member 70, while the longitudinal fixed bar 9 is seated on the groove 71 formed on the other end of the movable member 70. In addition, the torsion bar 6 is fitted into a support pipe 10, while the pipe 10 is connected to the longitudinal fixed bar 9 by a support plate 11.

The operational effect of the chair according to this invention will be described below.

Figure 7:
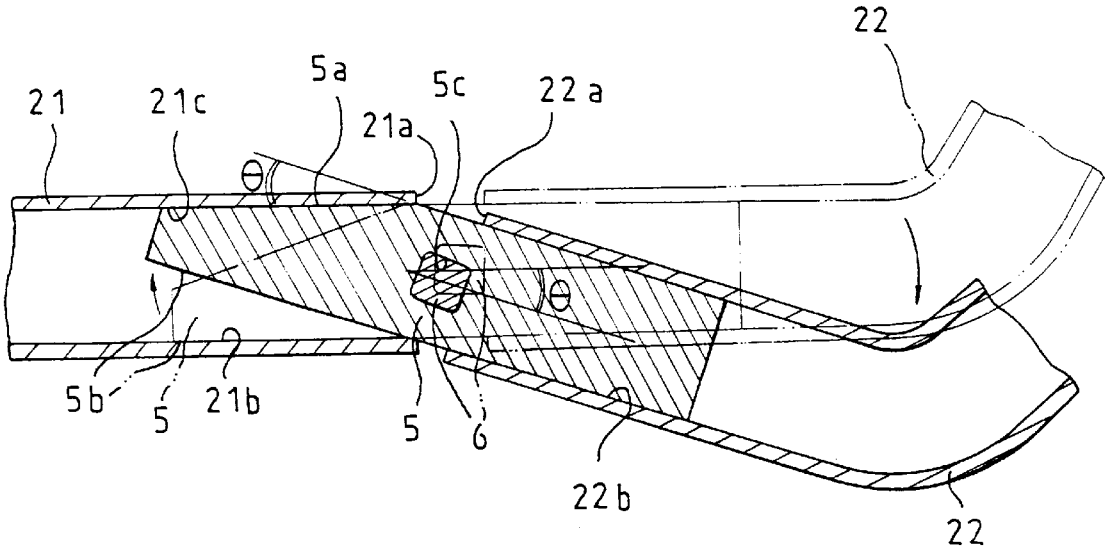
FIG. 7 is a view illustrating the operation of the elastic movable means of FIG. 2.
Figure 8:
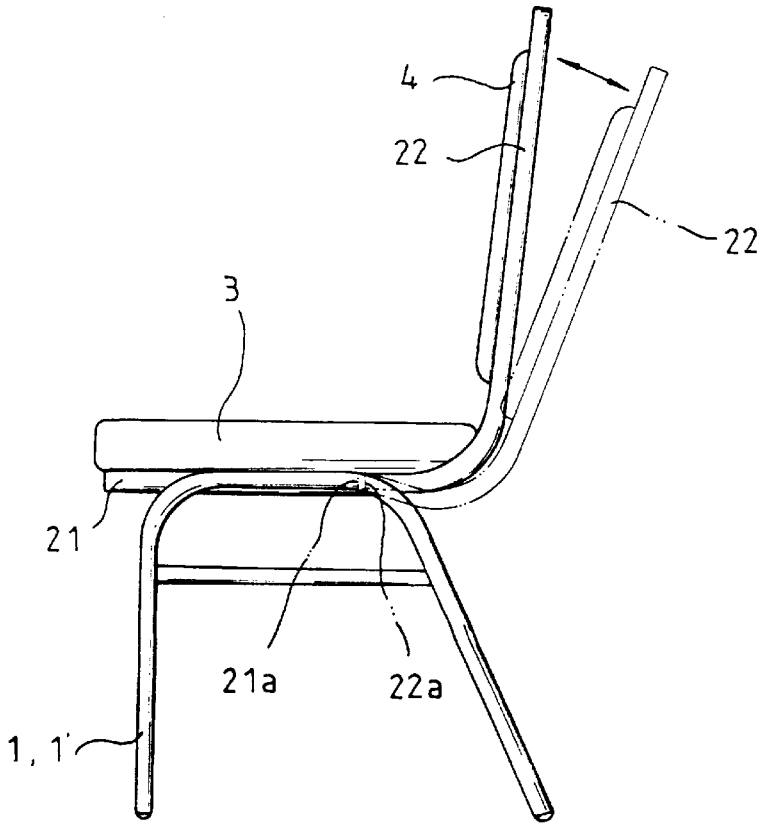
FIG. 8 is a view illustrating the leaning operation of the back of the chair according to this invention.

As far as any external force is not applied to the back 4, the elastic movable means "B" is free from any torque and the back frame 2 is maintained at its original position (see FIGS. 1 and 8). In such a case, the bottom surface 5*b* of each of the two limit units 5 comes into contact with the lower surfaces 21*b*, 22*b* of the seat and back frames 21 and 22 (see FIG. 7).

When a user wants to take a rest, the user leans back in the chair. In such a case, the back of the chair is pushed back, so the back frame 22 is rotated clockwise on the torsion bar 6. In a detailed description, when the back frame 22 is rotated clockwise, the tapered top surfaces 5*a* of the leaning angle limit units 5 are also rotated clockwise and are forcibly moved toward the interior upper surfaces of the seat frame 21. Accordingly, the torsion bar 6, fixed to the limit units 5, is also rotated clockwise.

That is, since a central portion 6*a* of the torsion bar 6 is fixed to the support pipe 7 as shown in FIG. 2, both ends 6*b* of the torsion bar 6 are distorted in the same direction as the rotating direction of the pipe 7. When the tapered top surface 5*a* of each of the limit units 5 comes into contact with the interior upper surface of the seat frame 21, the rotating action of the two limit units 5 are stopped, thereby causing the back frame 22 to be forcibly stopped.

In such a case, when the tapering angle θ of each of the top surface 5*a* is designed to be larger than the predetermined angle, the back frame 22 can be leaned back at a larger leaning angle. On the contrary, when the tapering angle θ of each of the top surfaces 5*a* is designed to be smaller than the predetermined angle, the back frame 22 will be leaned back at a smaller leaning angle. Therefore, the leaning angle of the back frame 22 relative to the seat frame 21 may be controlled by adjusting the tapering angle θ of the top surfaces 5*a*.

When the back of the user is removed from the back 4 of the chair "A", the torsion bar 6, distorted at an angle of inclination, is free from any torque, thus being elastically returned to its original position due to its restoring force. That is, since both ends 6*b* of the torsion bar 6 are elastically rotated counterclockwise, the bottom portion 5*b* of each of the limit units 5 comes into contact with the interior lower surface 21*b* of the seat frame 21. Therefore, the rotating action of the two limit units 5 is stopped at its original position, thus causing the back frame 22 to be spontaneously stopped at its original position.

The operational effect of the chair with the restoring force adjusting means "C" will be described below.

Figure 9:
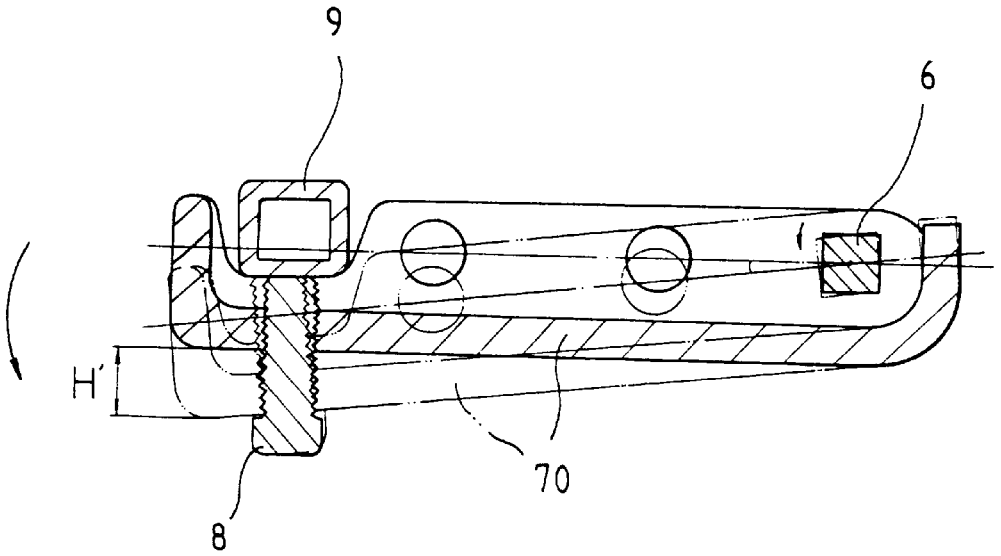
FIG. 9 is a view showing the operation of the adjusting means of FIG. 6.
Figure 10:
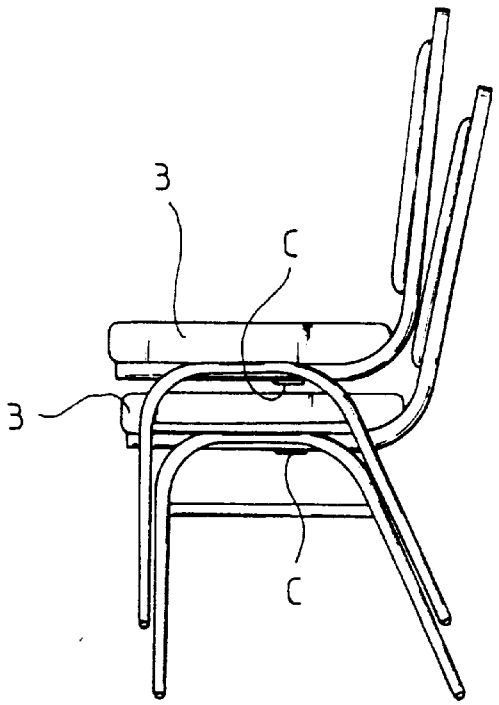
FIG. 10 is a view showing chairs of this invention with one being laid on top of another.

FIG. 9 is a view showing the operation of the above adjusting means "C".

In the same manner as that described for the primary embodiment of this invention, when any external force, applied to the back frame 22, is removed, the back frame 22 is elastically returned to its original position due to the restoring force of the torsion bar 6.

When the torsion bar 6 is positioned at its original position, the adjusting means "C" is positioned as shown by the solid line of FIG. 9. In order to increase the restoring force of the elastic movable means "B", the adjustable screw 8, which is threaded into the movable member 7, is moved in a tightening direction, thus rotating the movable member 7 counterclockwise. When the adjustable screw 8 moves upwardly to a height H' as shown in FIG. 9, the rotating angle of the movable member 7 is maximized, so the torsion bar 6 has the maximum restoring force. In such a case, the back frame 22 can be leaned back at a maximum leaning angle.

That is, when the movable member 7 is rotated in a direction as shown by the arrow of FIG. 9, the torsion bar 6 is also rotated in the same direction. Thus, the restoring force of the torsion bar 6 is increased, causing the back frame 22 to be effectively leaned back and elastically returned to its original position. Accordingly, the leaning angle and restoring force of the back frame 22 may be easily controlled by moving the adjustable screw 8 within the height H'.

In addition, as shown in FIG. 6, since the length L of the movable member 7 is very larger than its height H, the height H of the member 7 has the same slim construction as that of the leaning angle limit units 5. Also, when the chairs are laid on top of another, the restoring force adjusting means "C" of an upper chair is spaced apart from the seat 3 of a lower chair by 1 cm. Therefore, the seats 3 of the chairs are not brought into direct contact with or damaged by such adjusting means "C" even when a plurality of chairs are laid on top of another on a limited area. The chairs of this invention are thus easily stacked on such a limited area without being damaged.

As mentioned above, the chair according to this invention comprises an elastic movable means. The above elastic movable means includes two leaning angle limit units and one torsion bar mounted to the two limit units at both ends. Due to the elastic movable means, the back of the chair can be leaned back at an angle of inclination. In addition, the leaning angle limit units are individually formed by integrating two or more members, having the same size and configuration, into a single body. The above elastic movable means also includes a means for adjusting the restoring force of the elastic movable means. The chair thus allows a user to take a comfortable rest in the chair. Also, both ends of the torsion bar are easily and simply inserted into the two limit units, thus improving work efficiency and reducing production cost while producing the chair.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A chair, comprising:

at least two leg frames;

a seat frame formed from hollow pipes mounted to a top portion of said leg frames and holding a seat;

a back frame formed from hollow pipes connected to said seat frame and holding a back of the chair; and elastic movable means provided at a junction between said seat and back frames and adapted for allowing the back frame to be elastically leaned back relative to the seat frame, said elastic movable means having two leaning angle limit units and a torsion bar connected to and extending between the two leaning angle limit units, each of said leaning angle limit units being fitted into the hollow pipes of both said seat and back frame and being adapted for limiting a leaning angle of the back frame, and said torsion bar elastically returning the back frame from a leaned position to its original position.

2. A chair as claimed in claim 1, wherein said torsion bar is provided with means for selectively adjusting a restoring force of said elastic movable means.

3. A chair, comprising:

at least two leg frames;

a seat frame formed from hollow pipes mounted to a top portion of said leg frames and holding a seat;

a back frame formed from hollow pipes connected to said seat frame and holding a back of the chair; and elastic movable means provided at a junction between said seat and back frames and adapted for allowing the back frame to be elastically leaned back relative to the seat frame, said elastic movable means having two leaning angle limit units and a torsion bar connected to and extending between the two leaning angle limit units, each of said leaning angle limit units being fitted into the hollow pipes of both said seat and back frames, each of said leaning angle limit units being tapered on its top surface at a portion fitted into the hollow pipes of said seat frame, thus forming a tapered top surface and limiting the leaning angle of said back frame within a tapering angle of the tapered top surface, and being adapted for limiting a leaning angle of the back frame, and said torsion bar elastically returning the back frame from a leaned position to its original position.

4. A chair as claimed in claim 3, wherein said leaning angle limit units are individually formed of a metal.

5. A chair as claimed in claim 3, wherein said leaning angle limit units are individually formed of a synthetic resin material.

6. A chair as claimed in claim 3, wherein said leaning angle limit units are individually formed by integrating two or more members, having the same size and configuration, into a single body.

7. A chair as claimed in claim 3, wherein said adjusting means comprises:

a longitudinal movable member fitted over said torsion bar at one end, thus being rotatable along with said torsion bar;

an adjustable screw vertically and upwardly threaded into the other end of said movable member; and a longitudinal bar fixed to said seat frame and seated on said adjustable screw at a middle portion, thus allowing said movable member with the torsion bar to be selectively rotated in either direction in accordance with a moving direction of the adjustable screw and adjusting the restoring force of the elastic movable means.

* * * * *